United States Patent [19]

Serata

[11] Patent Number: 4,836,612

[45] Date of Patent: Jun. 6, 1989

[54] STRESS CONTROL MINING METHOD AND APPARATUS

[75] Inventor: Shosei Serata, Richmond, Calif.

[73] Assignee: Serata Geomechanics, Inc., Richmond, Calif.

[21] Appl. No.: 89,322

[22] Filed: Aug. 25, 1987

[51] Int. Cl.[4] ..... E21L 27/24; E21D 15/44

[52] U.S. Cl. ..... 299/11; 299/19; 405/299

[58] Field of Search ..... 299/11, 12, 19, 30, 299/33; 248/354.1; 405/299, 300, 298

[56] References Cited

U.S. PATENT DOCUMENTS

| | | | |
|---|---|---|---|
| 3,077,741 | 2/1963 | Haarmann | 299/11 |
| 3,592,010 | 7/1971 | Gaskell et al. | 405/300 |
| 3,673,807 | 7/1972 | Serata | 299/19 X |
| 3,856,356 | 12/1974 | Allen et al. | 299/11 |
| 4,679,856 | 7/1987 | Lubogatsky et al. | 299/11 |
| 4,737,051 | 4/1988 | Büll | 405/298 X |

FOREIGN PATENT DOCUMENTS

| | | | |
|---|---|---|---|
| 1208271 | 1/1966 | Fed. Rep. of Germany | 299/11 |

*Primary Examiner*—William P. Neuder

*Attorney, Agent, or Firm*—Harris Zimmerman; Howard Cohen

[57] ABSTRACT

A method and apparatus for mechanized, stress control mining includes the process of continuously cutting and advancing a broad mine face to form a mine opening having a low aspect ratio and an envelope of ambient stresses in the earthen media that protects the roof and floor from failure. At the advancing face the roof is supported by the apparatus of the invention, a superlifting stress control machine. The stress control machine comprises a plurality of support column assemblies, each capable of lifting up to 10,000 tons. The support column assemblies are arrayed at the mine face, and are interconnected by telescoping hydraulic arms so that individual support columns may be unloaded and translated with respect to the operating, anchored support columns. Alternatively, the column assemblies may be mounted in groups on tracked vehicles for high mobility. The lifting element of the support column assembly is an inflatable hydraulic tube formed of plastic reinforced with layers of braided super-strength filament. The lifting elements are arrayed in layers of closely abutting elements and coupled to displace vertically an upwardly extending column. The column is formed of a densely packed bundle of hollow tubular members filled with an incompressible plastic or the like and wrapped by a plurality of high strength filaments to form a lightweight, superstrong column.

32 Claims, 11 Drawing Sheets

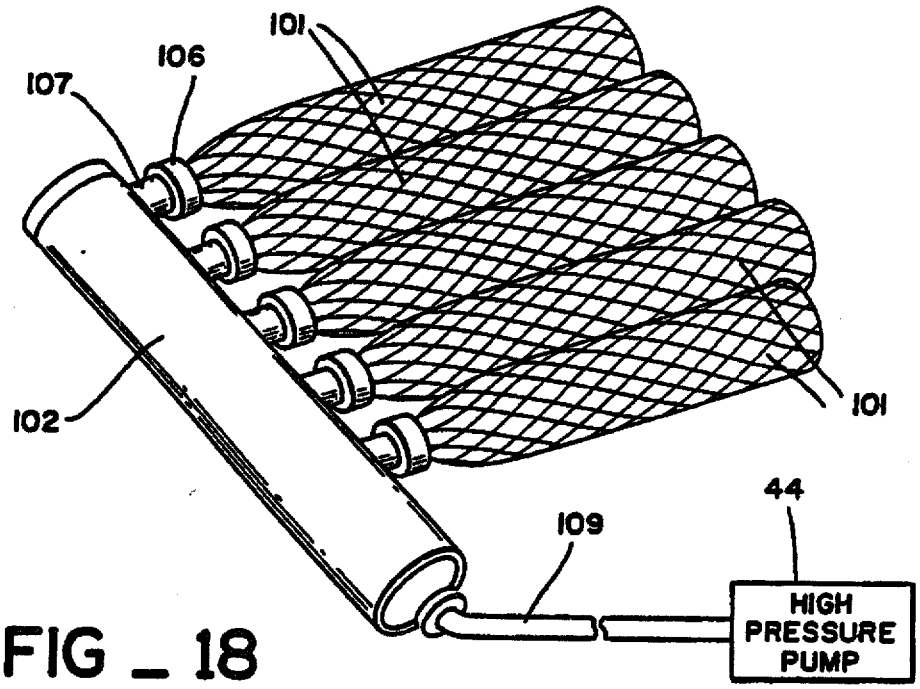
FIG _ 18
FIG _ 22
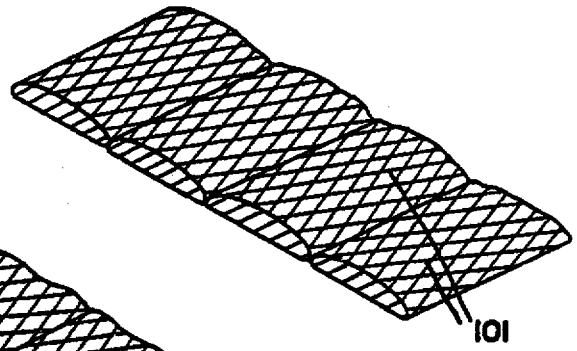
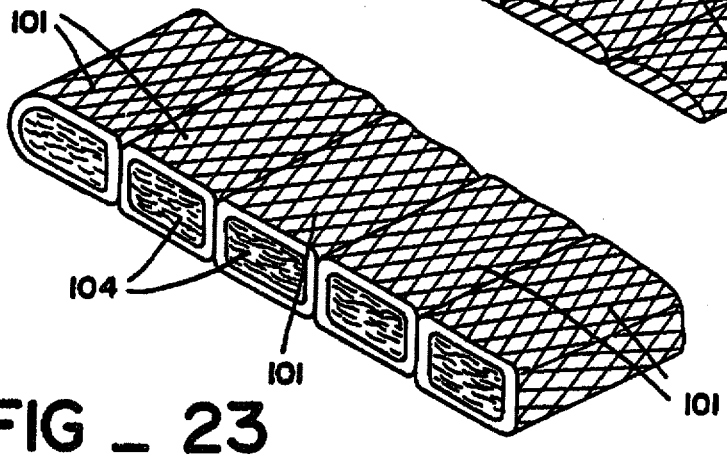
FIG _ 23

STRESS CONTROL MINING METHOD AND APPARATUS

Background of the Invention

The state of underground mining today is made unnecessarily difficult in operation, and dangerous for workers by unsound modern mining practices fortified with century old traditions that defy rational geomechanical analysis of mine openings. The difficulty and danger come from fundamental errors in prior art methods of mine design. With conventional mining methods, stability of underground openings is unpredictable and often gets into uncontrollable ground failure problems which interfere with the mining operation, if not forcing abandonment. The two major failure problems are heaving of the floor and falling of the roof of the mine openings.

When failures are encountered, the conventional method of control is to install ground support to slow down the failure. This method is often found to be a temporary measure merely delaying the failure. Yet, the industry today is totally dependent upon this artificial support method. To maintain a safe mine opening requires repeated renewal of supports such as roof bolting, artificial pillars, arches and trusses.

These artificial means of ground support are, however, time-consuming to install and costly to maintain. They are often replaced at great danger, inconvenience, and expense. These ground control problems make economical recovery of natural resources extremely expensive and dangerous, and consequently, some operations have to be abandoned, after a heavy initial investment, when it is discovered that the ground is uncontrollable.

Even if vast amounts of artificial supports are introduced and maintained, the conventional mining method requires that a large amount of the ore body be left unmined to support the mine openings at a heavy loss of the recoverable resources. This conventional method has been institutionalized by tradition and reinforced by fedral regulations requiring large size pillars and small room widths in mine openings. For example, it is typical to have maximum room widths of 20 feet, the pillar widths several times the room width to support the overburden. This approach may seem to embody common sense, but in fact it is a fundamental misconception that is the basis for mine design as it is known in the prior art. The small rooms combined with the large pillars cause high stress concentrations around the individual openings, and the concentration of stress on the immediate boundary of the opening initiates failure on the boundary of the opening where material strength is weakest because of exposure to open air.

Philosophically, the conventional method is to combat the natural stress field in the earth, using artificial supports. Regardless of this support weak ground usually fails as the support deteriorates, due to the ever present earth stresses.

The concept of utilizing, rather than resisting, the natural stress field in the ground was first introduced in U.S. Pat. No. 3,673,807, issued on 7/4/1988 to the present inventor. In that method, a pair of parallel, spaced apart mine openings is first formed in the ground, each forming an individual primary stress field thereabout in the ground media. A media opening is then formed between the two initial openings, thereby creating a primary stress envelop surrounding all the openings together and alleviating high stress concentrations near the openings. As a result, the openings are stable and safe with little or no artificial support. This is a brief summary of the method elucidated in the patent referenced above.

Although the prior art method of stress control mining is revolutionary in concept and realization, it still requires the tedious process of cutting small openings in a certain strictly controlled sequence to establish the protective stress envelope. And, the yield pillars between the adjacent rooms represent a portion of the ore body that remains unextracted.

Summary of the Invention

The present invention generally comprises in one aspect an improved stress control mining method which eliminates the previous small opening approach in favor of large opening, continuous mining. The new method greatly increases the extraction ratio for mines, and provides large, stabilized mine openings requiring little or no artificial support. Another aspect of the invention is the provision of a super lifting machine to support the mine at the advancing face of the large opening and to permit the establishment and maturation of a large protective stress envelope about the large opening.

In the method of the present invention, a large mine opening is formed in one continuous process. The mine opening has a very low height/width (aspect) ratio, causing the ambient stress field within the ground media to form a large stress envelope about the opening. For example, the rooms may be 100 feet wide or more, with a typical working height of approximately 6 feet. The stress envelope approaches the opening only near the side walls of the opening; substantial portions of the roof and floor are protected from failure by the large distance of the stress envelope from the roof.

The only location in which the stress envelope does not protect the mine opening is at the advancing face of the opening. The present invention provides a unique super-lifting stress control machine deployed at the mine face to eliminate ground deterioration in the process of cutting the wide room. The stress control machine comprises a plurality of portable support columns generally disposed in an array and adapted to support the roof and floor at the advancing mince face. The support columns are may be disposed in an array including hydraulic arms extending laterally therebetween to connect adjacent columnsand facilitate spider locomotion of the array with the advancing face. Alternatively, one or more of the support columns may be mounted on a vehicle having caterpillar treads for high mobility. Each column includes at least one hydrostatic jack, constructed in accordance with the invention, which is capable of operating at pressures above 10,000 psi to exert approximately 5–10,000 tons of force between the floor and ceiling of the opening. Inflated hydrostatic jacks secure the roof and floor adjacent to the advancing face, and the hydraulic arms or tracked vehicles permit the jack-column assemblies, when deflated, to be repositioned with respect to the active columns as the mine face advances. Behind the super-lifting column array, the mature stress envelope of the mine opening protects the roof and floor.

Brief Description of the Drawing

FIG. 18 is a perspective representation of the hydrostatic jack assembly of the present invention.

FIG. 22 is a cutaway perspective view of an array of lifting cylinders forming a portion of a lifting jack of the present invention, shown in the deflated disposition.

FIG. 23 is a cutaway perspective of the array of FIG. 22, showing the lifting cylinders in the inflated, loading disposition.

Description of the Preferred Embodiment

Figure 1:
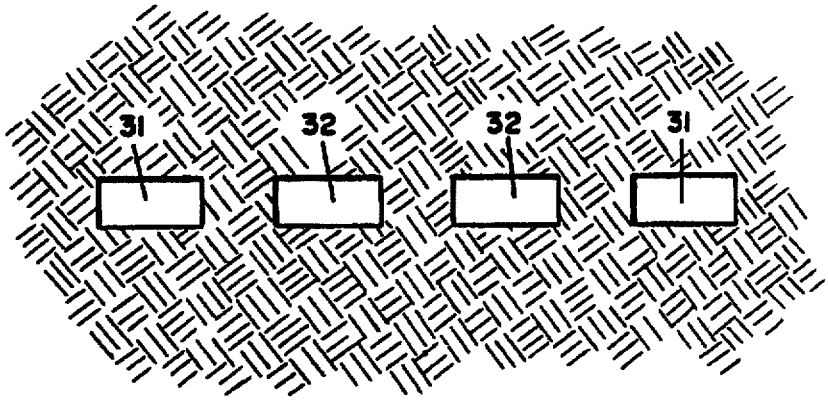
FIG 1 (PRIOR ART)
FIG. 1 is a cross-sectional elevation of a mine entry plan in accordance with the stress control mining method of the prior art.
Figure 2:
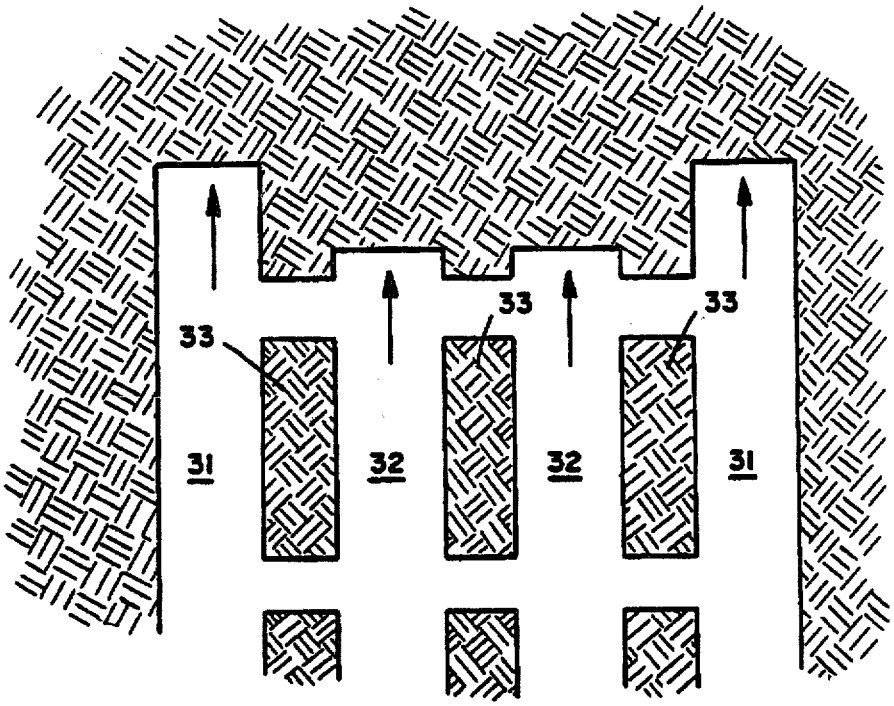
FIG 2 (PRIOR ART)
FIG. 2 is a plan layout of the prior art mine entry arrangement of FIG. 1.

The present invention generally comprises a method and apparatus for mechanized stress control mining; that is, an approach to mining in which the stress field in the earth media surrounding a mine opening is made to stabilize and secure the opening, rather than to cause its destruction. A major feature of the invention is ability to form large openings using continuous mining methods, thus eliminating the previous small opening approach of prior art stress control mining as well as room and pillar methods. With regard to FIGS. 1 and 2, the prior art stress control mining method, disclosed in U.S. Pat. No. 3,673,807, generally involves the cutting of two parallel, spaced apart openings 31 in an underground area, using standard mining machines known in the prior art. The ambient stresses within the earth media react to the openings by forming a separate stress envelope extending closely concentrically about each opening 31. The stress lines are defined close to the mine walls, generally tending to cause the roof to sag, the floor to buckle upwardly, and the walls to buckle inwardly. Such stresses quickly cause the openings 31 to fail.

A plurality of medial openings 32 are then cut through the same underground area, extending parallel to and intermediate of the original, outside openings 31. The size and spacing of the openings 32 is chosen so that the openings 32 pass through the stress envelopes surrounding the outside openings 31. The ambient stress field in the underground media reforms as a stress envelope extending concentrically about all of the openings 31 and 32 together. The spacing of the stress envelope far from the roof and floor of the medial openings 32 protects those openings from destructive stresses, and the strength of the ground is generally sufficient to require little or no roof supporting bolts and the like. The pillars 33 between the medial and outer openings are rather narrow, and may be removed in retreat to achieve a high extraction ratio.

Figure 3:
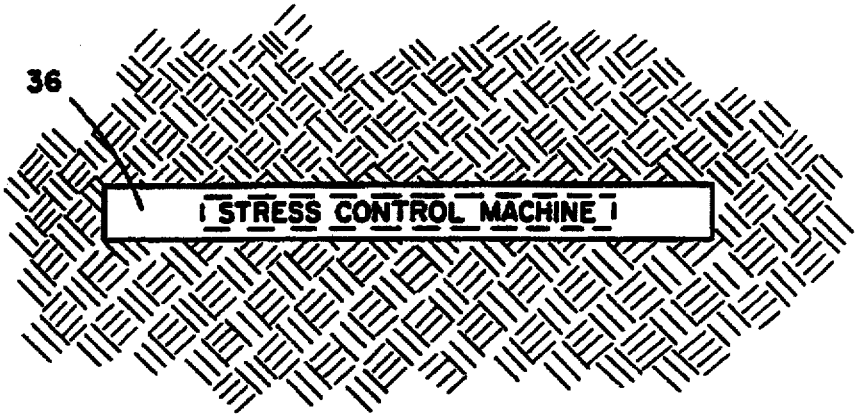
FIG. 3 is a cross-sectional elevation of a mine entry plan demonstrating the fundamental concept of the stress control mining method of the present invention.
Figure 4:
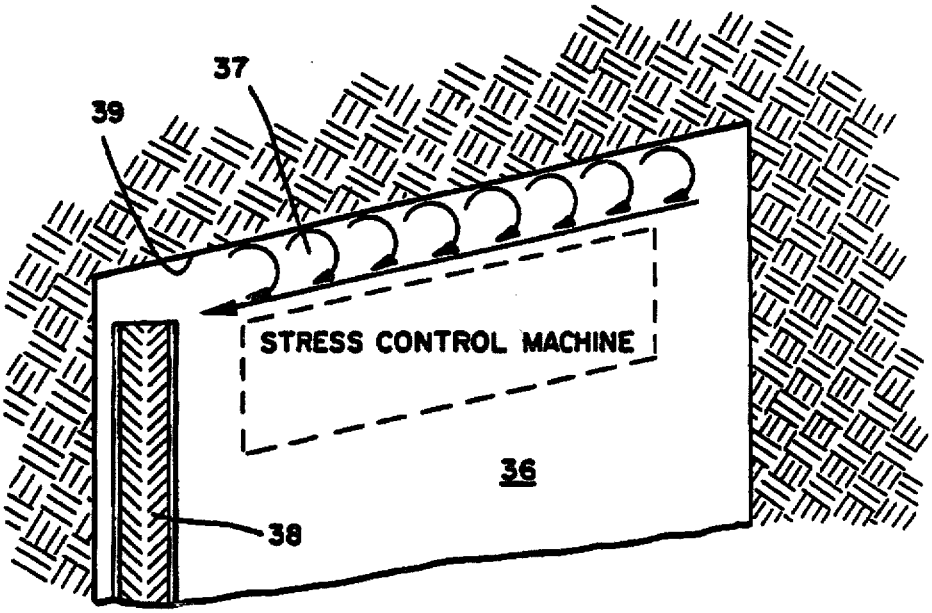
FIG. 4 is a plan layout of the mine entry arrangement shown in FIG. 3.
Figure 5:
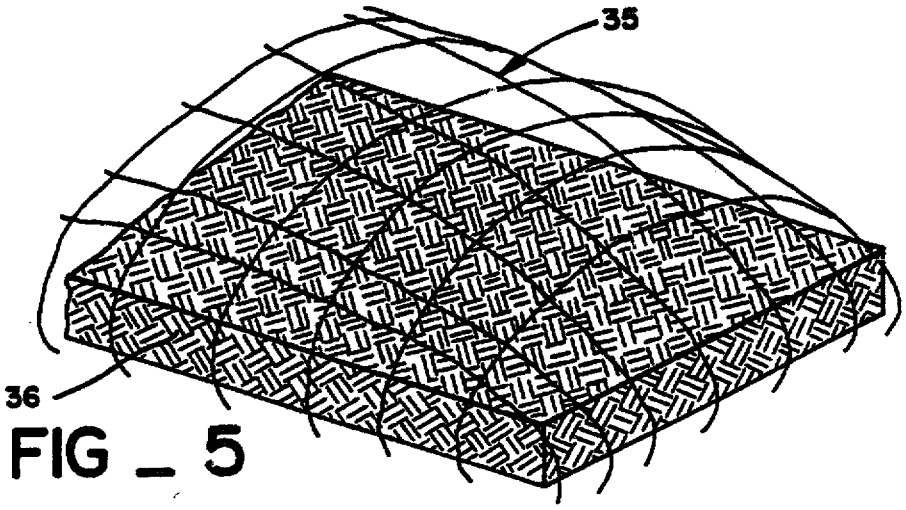
FIG. 5 is a perspective representation of the protective stress envelope extending about a mine opening formed in accordance with the present invention.
Figure 19:
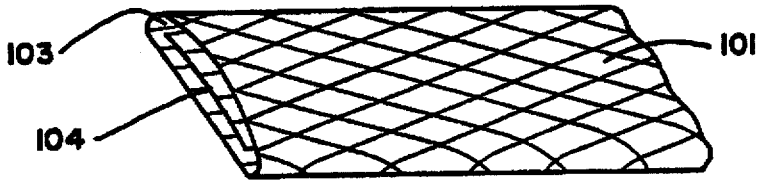
FIG. 19 is a cutaway perspective view of a portion of one tubular braided lifting cylinder of the present invention.
Figure 20:
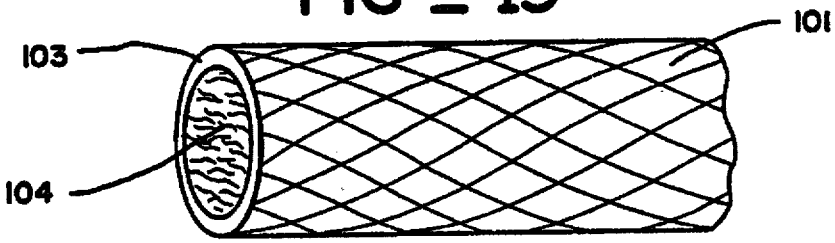
FIG. 20 is a cutaway perspective view of a portion of one tubular braided lifting cylinder of the present invention, shown in the inflated, non-loaded disposition.
Figure 21:
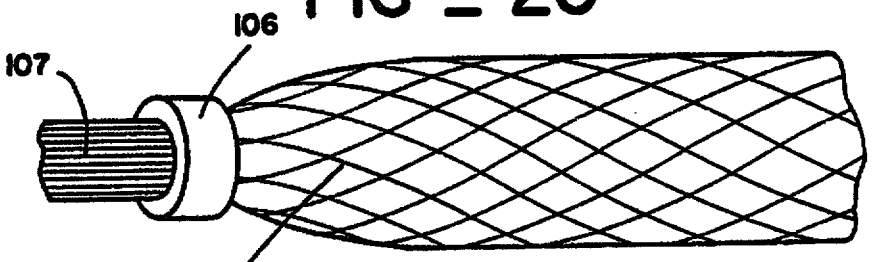
FIG. 21 is perspective view of a portion of one tubular braided lifting cylinder of the present invention, showing the end termination and connection to a high pressure hydraulic source.

With regard to FIGS. 3-5, the present invention comprises an improved stress control mining method in that it provides for the formation of and extraction from a wide mine opening 36 in a single pass, full extraction opening. Compared to mine openings in orthodox mining engineering, the opening 36 is very wide and low in floor-to-ceiling height. For example, standard room width is 20 feet in room and pillar mining; a typical room width of the present invention is approximately 100 feet, with floor to roof distance approximately the same in both cases. This low aspect ratio configuration requires that the ambient stress field 35 within the earthen media must form an elliptical, tubular configuration about the opening 36, as shown in FIG. 5. The spacing of this stress envelope 35 from the opening protects the roof and floor of the opening 36 in the same way that the openings 32 are protected in the prior art method. The opening 36 is advanced by use of a continuous mining system 37 which cuts into a mining face 39, the ore and rock being removed by a conveyor belt 38 or the like.

However, it should be noted that the stress envelope 35 does approach the opening at the side walls of the opening, and it can be predicted that the side walls may spall to a minor extent. Most mining activities can be confined to the central area through the opening. Indeed, a major advantage of the present invention is that the wide opening provides easy access by workers, power machines, and haulage systems. Unfortunately, the advancing face 39 of the opening is also vulnerable to damage from the primarily compressive stresses of the stress envelope, and the advancing face must be the location of a great deal of human and machine activity. Thus it is apparent that the area adjacent to the advancing face 39 must be protected from the damaging effects of the stresses in the earth adjacent thereto.

Figure 6:
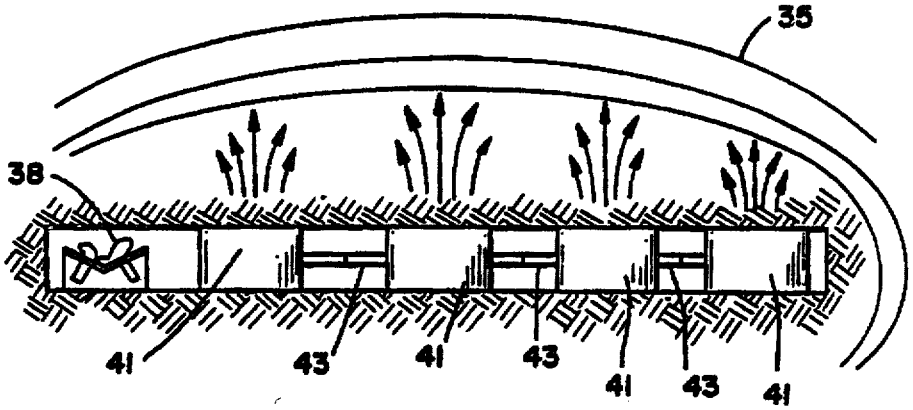
FIG. 6 is a schematic cross-sectional view of the stress control machine used in a mine opening to carry out the mining method of the present invention.
Figure 7:
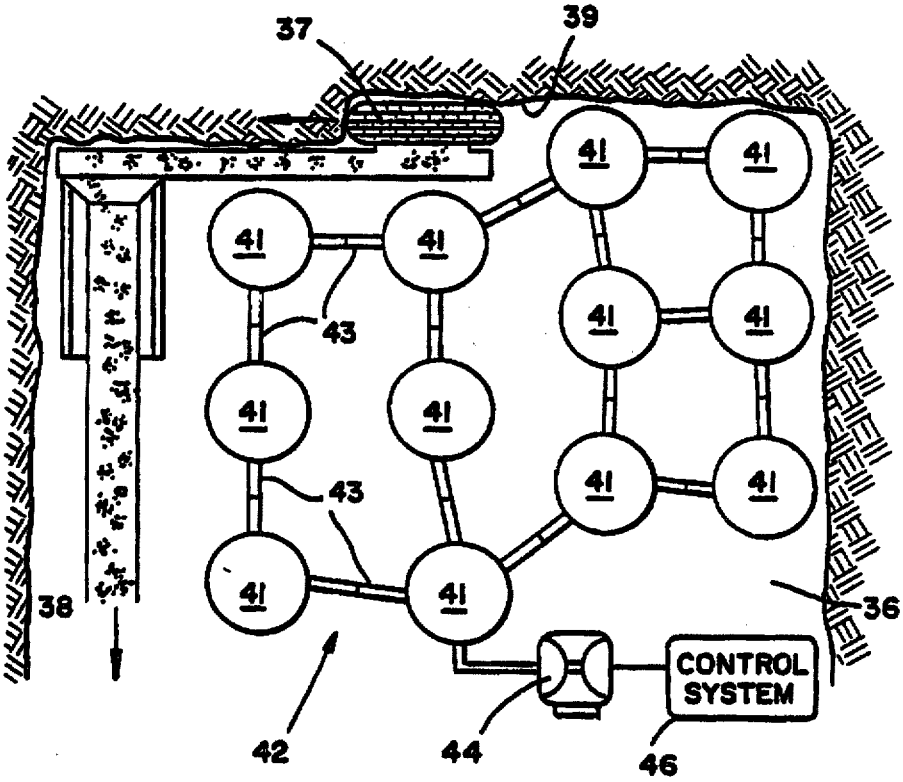
FIG. 7 is a schematic play layout of the stress control machine as shown in FIG. 6.

Therefore a salient feature of the present invention is the provision of a novel mechanical support for temporarily resisting the effects of stress and loading on the area adjacent the face 39, so that the mine opening may be advanced safely. The invention introduces the concept of a plurality of super-lifting support assemblies 41, as shown in FIGS. 6 and 7. Each support assembly 41 embodies a unique design that permits the assembly 41 to exert an enormously large force between the floor and roof of the opening 36, on the order of 5,000–10,000 tons. The support assemblies are disposed in an array 42 of calculated, predetermined layout to generate sufficient expansion between the floor and roof to support the total load of the roof formation adjacent to the wide face 39. The lifting force eliminates deterioration of the ground by avoiding a high concentration of the shear stress at the face of the advancing excavation. In terms of the stress field about the opening, the support assemblies exert sufficient vertical force to displace the stress envelope away from the roof and floor of the opening, as shown in FIG. 6. This temporary support is virtually the only mechanical support required to sustain the mine opening.

Not only does the array 42 support the roof, it is provided with the ability to be self-mobile so that it may advance as the cutter 37 and haulage system 38 advance into the face 39. For this purpose, a plurality of telescoping hydraulic arms 43 are provided, interconnecting the support assemblies 41, as will be detailed below. The hydraulic arms 43 and the support assemblies 41 are connected to a hydraulic pumping system 44, the support assemblies 41 operating at pressures of 10,000 psi and above, the arms 43 operating at more conventional, lower pressure. The expansion and relaxation of each of the support assemblies is managed by a control system 46, preferably a computer system programmed to monitor and respond to various, mining operation parameters, ground conditions, and the like. The system software can also regulate the high pressure, high volume hydraulic pumps.

It may be appreciated that not all of the assemblies 41 need to be expanded at any one time to provide effective and safe roof support. A relaxed support assembly may be translated to a new location with reference to the expanded, operating assemblies by use of the hydraulic arms 43. It is a relatively simple task for a skilled individual in the computer arts to develop software to provide virtually any combination of X-Y motions to any assembly 41 and push it to a new, desired location. There it may be re-expanded to support the roof, while other assemblies 41 are moved in the same fashion. In this manner the entire array may creep forward with face 39.

Indeed, the movement of the array is similar to spider locomotion, in that some legs remain absolutely stationary in support, while others are free to be advanced or otherwise moved. The array 42 may be viewed as a singular robot assembly which, under computer control, is capable of spider locomotion in any direction. Thus the present invention makes possible the long-sought goal of robotization of mining, eliminating some of the most dangerous and debilitating occupations known in industrialized society. A computer system may control the array 42, the cutter machine advancing into the wall, and the haulage system carrying the ore away. The miners may supervise and monitor the overall system from a remote location some distance from the face in a more stable, secure, and safe area.

Figure 24:
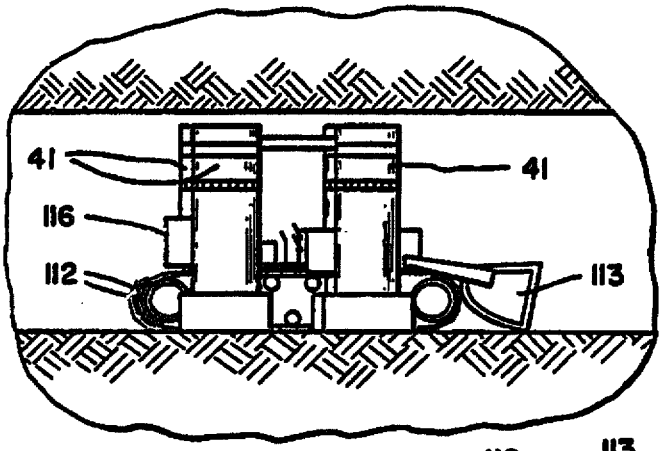
FIG. 24 is a side view of a plurality of super-lifting column assemblies mounted on a caterpillar track vehicle.
Figure 26:
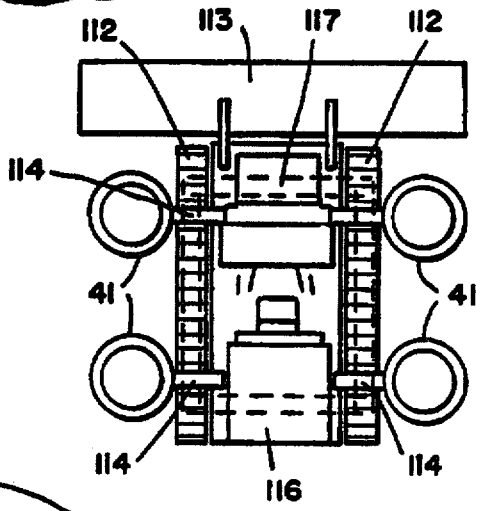
FIG. 26 is a plan view of the caterpillar track vehicle and super-lifting column assemblies shown in FIGS. 24 and 25.
Figure 25:
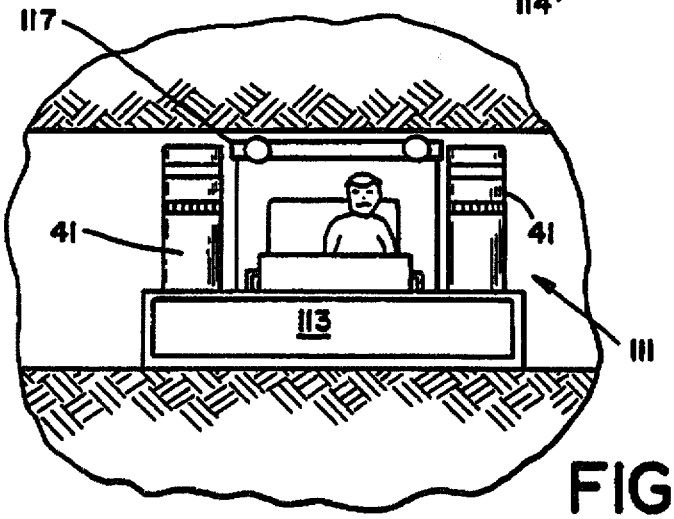
FIG. 25 is a front view of the caterpillar track vehicle assembly shown in FIG. 24.

A further embodiment of the invention, shown in FIGS. 24–26, provides enhanced mobility and maneuverability to the arrays of super-lifting column support assemblies 41. This embodiment provides a tractor vehicle 111 supported on a pair of caterpillar tracks 112, in the fashion of a crawler tractor assembly known in the prior art for earth moving purposes and the like. A plow or bulldozer blade 113 is secured to the front end of the tractor 111 to clear a path through rubble-strewn areas. A quartet of support column assemblies 41 described previously are secured to the tractor 111 by means of extendable arms 114. The tractor includes an hydraulic system 116, including pumps, control valves, and tanks connected to operate the support column assemblies 41 and the extendable support arms 114.

As shown in FIGS. 24 and 25, the vehicle includes a safety cage 117 supported above the medial portion thereof to protect the operator seated at the controls. The superlifting colums 41 are disposed in a generally, vertical orientation, with sufficient clearance in their retracted mode to permit transport by the vehicle 111 through the limited clearances of the mine opening. It is also feasible to rotate the columns about the arms 114 into a more oblique orientation to clear lower height limitations. The arms 114 are also hydraulically extendable to position the assemblies 41 in the desired configuration about the vehicle 111. It may be appreciated that the super-lifting columns, when actuated, extend from the floor to the roof of the opening, and that none of this load is exerted on the vehicle 111 itself. The combination of the caterpillar tracks and the blade 113 to provide high mobility and maneurability within the narrow confines of the mine, along with the self-contained contained hydraulics system to permit the use of super-lifting columns at any point in the mine without running extensive supply and service lines, creates a new mine support machine with unsurpassed versatility.

Figure 8:
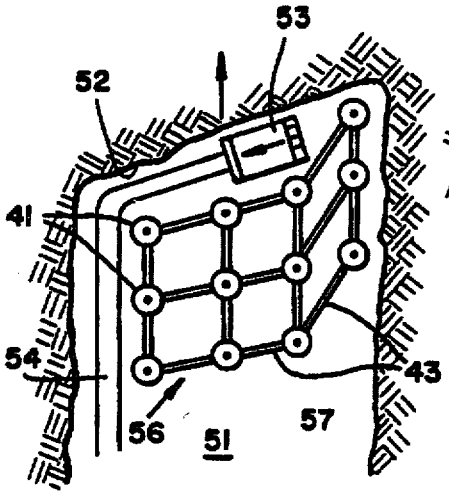
FIG. 8 is a schematic plan layout of the present invention used to advance a mine face in conjunction with a side belt ore conveyor.

The general method and apparatus of the present invention may be applied to specific mining layouts to realize great savings in manpower, time, equipment, and ore extraction. In the following descriptions, mine layouts are depicted using arrays of super-lifting support columns 41 to advance the mine opening and establish the protective stress envelope. These arrays may be formed of laterally interconnected column assemblies, or mobile arrays mounted on vehicles 111. As shown in FIG. 8, one typical layout includes a mine opening 51 having an oblique advancing face 52, the opening having the low aspect ration in accordance with the invention. A continuous mining machine 53 operates at the face 52, delivering ore and rock to a belt conveyor 54 extending adjacent to the side wall of the opening 51. A super-lifting support array 56 of individual support assemblies 41 is disposed directly adjacent to the face 52, as close as is practical to the mining machine 53 and extending substantially from the belt conveyor to the opposite wall 57. The support assemblies are linked by hydraulic arms 43, and are driven by automated control to advance as the mining machine and belt conveyor advance the face 52. Indeed, note that the column of support assemblies 43 adjacent to the wall 57 extends into the corner area formed by the wall 57 and face 52 to support the roof even at this extreme position. In the remainder of the opening 51 away from the face 52, the mature and stable stress envelope within the surrounding earth media protects the floor and roof. As noted above, the wide, protected room 51 provides ample space for transportation, haulage, and machine access. Furthermore, the need for roof bolting and roof maintenance is virtually eliminated, so that these activities do not interrupt mine production.

Figure 9:
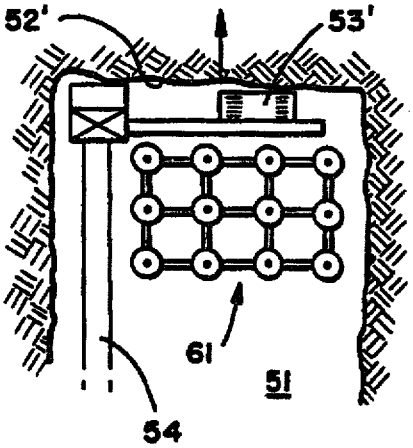
FIG. 9 is a schematic plan layout of the present invention used to advance a mine face in conjunction with a shear cutter mining machine.

A variation of the mine layout of FIG. 8 is depicted in FIG. 9, and like reference numerals refer to like objects or items, as is true throughout this description. The end face 52' extends generally transversely to side walls and to the direction of advancement, and a shear cutter 53' excavates the face 52' and delivers the ore rock to a side haul belt conveyor 54. A generally rectangular array of support assemblies 41 is disposed directly adjacent to the shear cutter and its associated material handling system to support the roof thereover. The operation and advantages of the layout of FIG. 8 generally pertain also to this embodiment.

Figure 10:
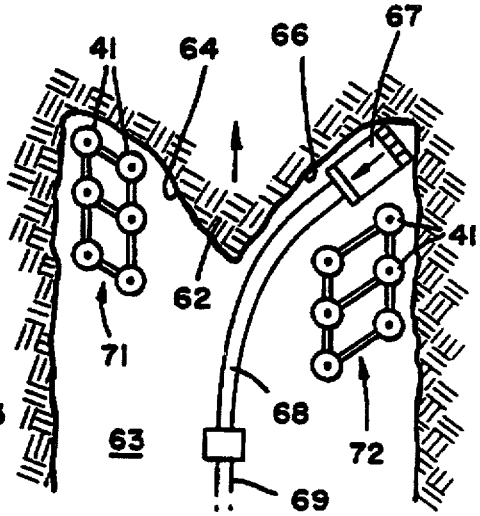
FIG. 10 is a schematic plan layout of a further embodiment of the method of the present invention, in which the advancing face has a Y configuration to form a central support pillar adjacent to the face.

Another application of the general method of the present invention, shown in FIG. 10, is devised to provide a central pillar member 62 adjacent to the advancing face to augment the support exerted by the array of support assemblies. The mine opening 63 has the same aspect ratio described above, and spaced, parallel side walls. The advancing face is comprised of two walls 64 and 66 extending from the side walls inwardly toward the center, the two walls curving slightly concavely and defining an "M" configuration with the side walls. The two walls 64 and 66 define the central pillar member 62 medially between the side walls and spaced proximally from the distal portions of the advancing face. It may be appreciated that presence of the pillar 62 supports the central roof portion adjacent to the advancing face, and reduces the number of support assemblies 41 required to support the roof adjacent to the working face.

A shear cutter 67 or the like is utilized to excavate first one of the walls 64 or 66, the adjustable haulage system 68 following the cutter 67 and delivering rock and ore to a fixed belt conveyor or the like extending proximally generally along a midline of the opening 63, thus traversing the most protected and stable portion of the opening. A pair of super-lifting support arrays 71 and 72 are disposed adjacent to advancing walls 64 and 66, respectively, and advance therewith as explained previously. With regard to FIG. 10, immediately after the wall 66 is excavated by the cutter 67, the cutter and its extendable hauling system 68 is moved to the wall 64 to begin excavation thereat, while the lifting array 72 advances in spider locomotion to support the roof load closely adjacent to the face 66 and its junction with the side wall. These steps are then repeated at the wall 64, and the opening 63 is thus advanced through the earth.

It should be noted that at the advancing end of the opening 63, a pair of small stress envelopes extend from the side walls to the confronting portions of the central pillar 62, and that the mature stress envelope capable of protecting the room is formed rearwardly (proximally) of the pillar 62.

Figure 11:
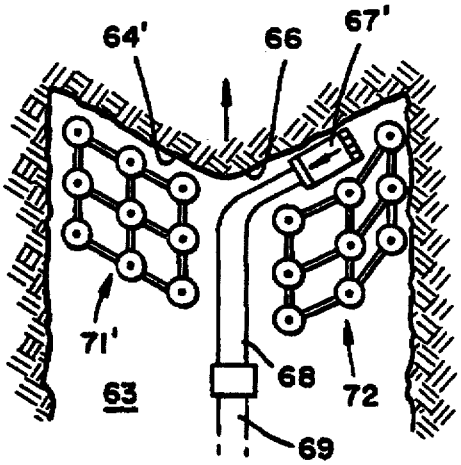
FIG. 11 is a schematic plan layout of a further embodiment of the method of the present invention, in which the advancing face has a V configuration to form a central support pillar.
Figure 12:
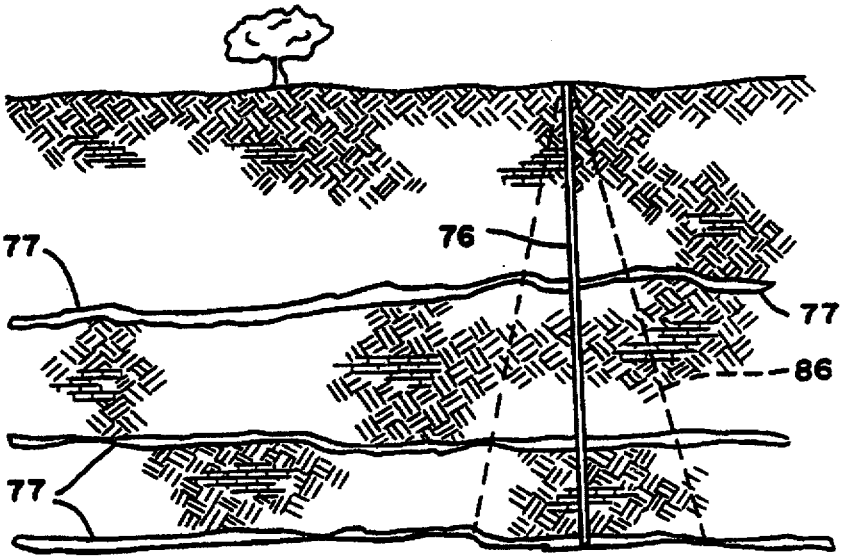
FIG. 12 is a cross-sectional elevation showing a typical mine profile.

A modification of the mine layout of FIG. 10, shown in FIG. 11, provides the formation of a mine opening 63' having two advancing end walls 64' and Δ', the end walls extending more obliquely with respect to each other and protruding far less into the excavated opening. The central support provided by the central pillar formation 62' is diminished in comparison to the layout of FIG. 10, and as a result the super-lifting arrays 71' and 72' include a greater number of support assemblies 41. In other respects the operation of this embodiment is substantially as described with reference to FIG. 10. In both embodiments, the salient advantages may be summarized as follows: (1) strengthening of the roof over the central room area; (2) less requirement of roof loading for proper formation of the protective stress envelope; (3) effective utilization of any existing continuous mining machine to cut the wide room; (4) effective use of existing haulage systems; (5) protection of the haulage system by routing along the center of the opening, alleviating failure in the worst-case scenario; and (6) a scheme to form super-wide rooms with multiple face protusion layout by parallel operation of the continuous mining machine.

Another modification of the general method of FIG. 10 is also devised to provide a central pillar member 162 adjacent to the advancing face to augment the support exerted by the array of support assemblies. With regard to FIG. 27, the mine opening 163 has the same aspect ration described above, and spaced, parallel side walls. The advancing face is comprised of two walls 164 and 166 extending from the side walls inwardly toward the center, the two walls curving slightly concavely and defining an "M" configuration with the side walls. The two walls 164 and 166 define the central pillar member 162 medially between the side walls and spaced proximally from the distal portions of the advancing face. As before, the presence of the pillar 62 supports the central roof portion adjacent to the advancing face, and reduces the number of support assemblies 41 required to support the roof adjacent to the working face.

A salient feature of this embodiment of the method is that the advancing faces 164 and 166 do not intersect, but rather are terminated at their inner extents to form a medial partition wall 165 extending approximately along or parallel to the midline of the tunnel opening. The partition wall 165, which is a non-bearing wall, divides the opening into air corridors 121 and 122. In addition, a plurality of openings 170 extend through the partition 165 at spaced intervals. The corridors 121 and 122 define an air flow path up to and away from the advancing faces 164 and 166, so that noxious mine gases cannot accumulate in mine areas intended for human activity. One corridor is in flow communication with a fresh air supply shaft, and the other corridor is connected to a vent tunnel which draws away the stale air and gases. The partition 165 is sufficiently narrow to avoid wasting any significant amount of ore, yet is the cheapest means of creating a curtain wall to define an air circulation path to the mine face.

A pair of shear cutters 167 and 167' or the like is utilized to excavate both of the walls 164 and 166, the respective adjustable haulage system 168 or 168' following the cutters 167 and delivering rock and ore to a fixed belt conveyor or the like extending proximally generally along a midline of the opening 163, along either side of the curtain wall 165. A trio of super-lifting support arrays on track vehicles 111 are disposed adjacent to advancing walls 164 and 166, respectively, and advance therewith as explained previously.

Figure 27:
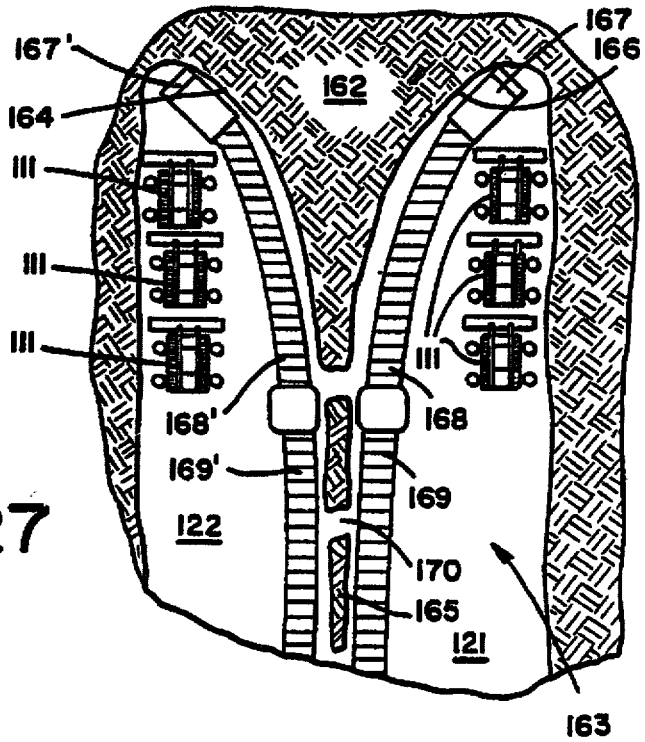
FIG. 27 is a schematic plan layout of a further embodiment of the method of the present invention, in which the advancing face has a Y configuration to form a central support pillar and a medical dividing wall, with ore conveyors and air supply ducts running adjacent to the dividing wall.
Figure 28:
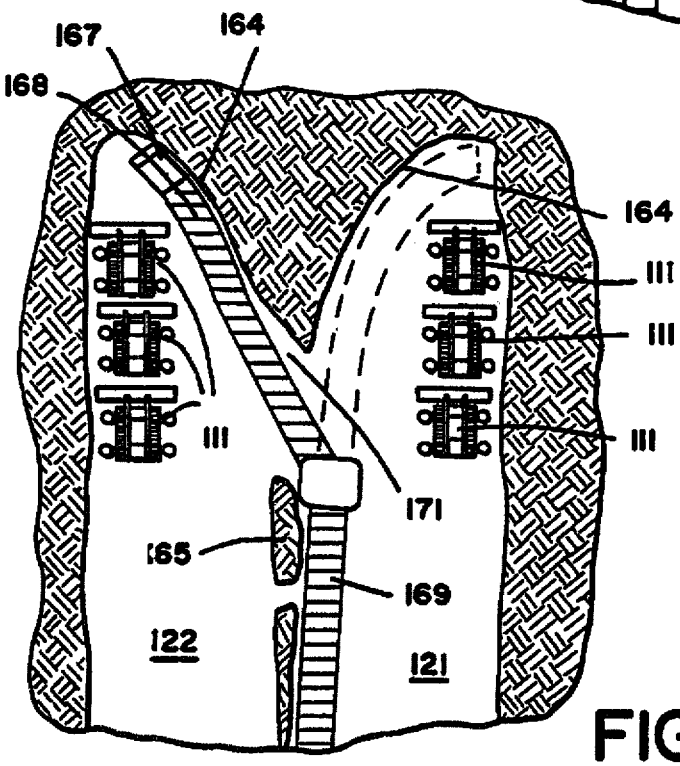
FIG. 28 is a schematic plan layout of a further embodiment of the method of the present invention, similar to FIG. 27, in which the advancing face has a Y configuration to form a central support pillar and a medical dividing wall, with ore conveyors and air supply ducts running adjacent to one side of the dividing wall.

A variation of the method shown in FIG. 27 is depicted in FIG. 28, in which common reference numerals refer to the same elements. In this embodiment, a single shear cutter 167 or the like is used, thus saving on capitalization costs. The curtain wall 165 is provided with a plurality of enlarged openings 171 instead of the openings 170, the openings 171 extending obliquely through the wall 165 to permit the outhaul conveyor 168 to be extended from the advancing face 164 in the corridor 122 to the conveyor line 169 in corridor 121. This layout also permits good air circulation in the mine opening, and conserves expenditures for face cutting machinery and ore conveyor systems. As before, the vehicles 111 advance the super-lifting columns 41 with the advancing mine faces.

Figure 13:
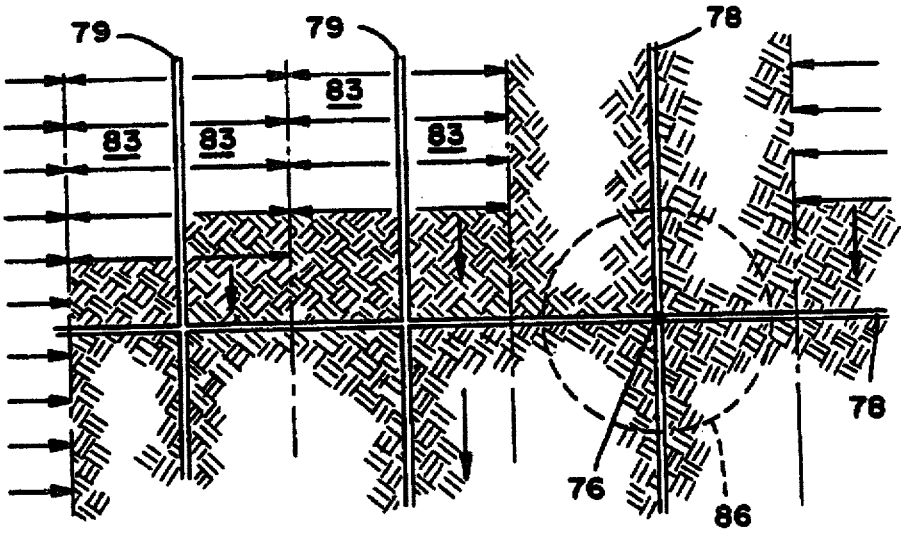
FIG. 13 is a plan layout showing uniform total extraction in retreat carried out using the mechanized stress method of the present invention.
Figure 14:
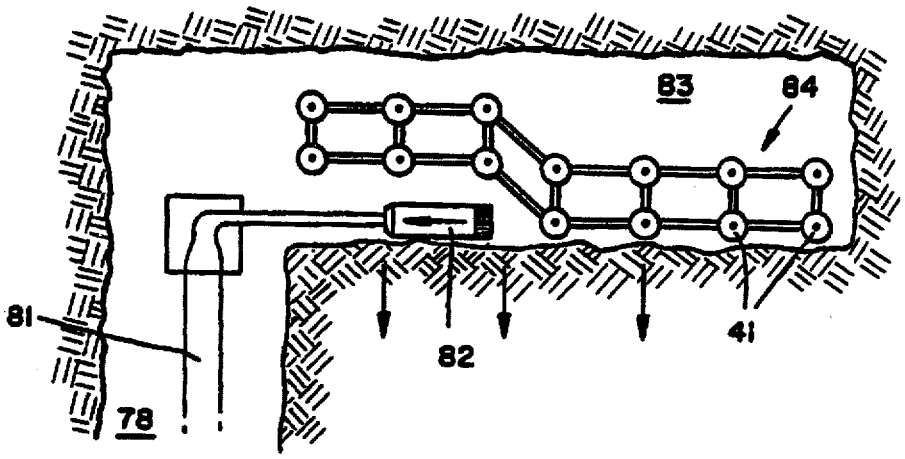
FIG. 14 is a plan layout showing initiation of a production panel in a mine opening constructed in accordance with the present invention.
Figure 15:
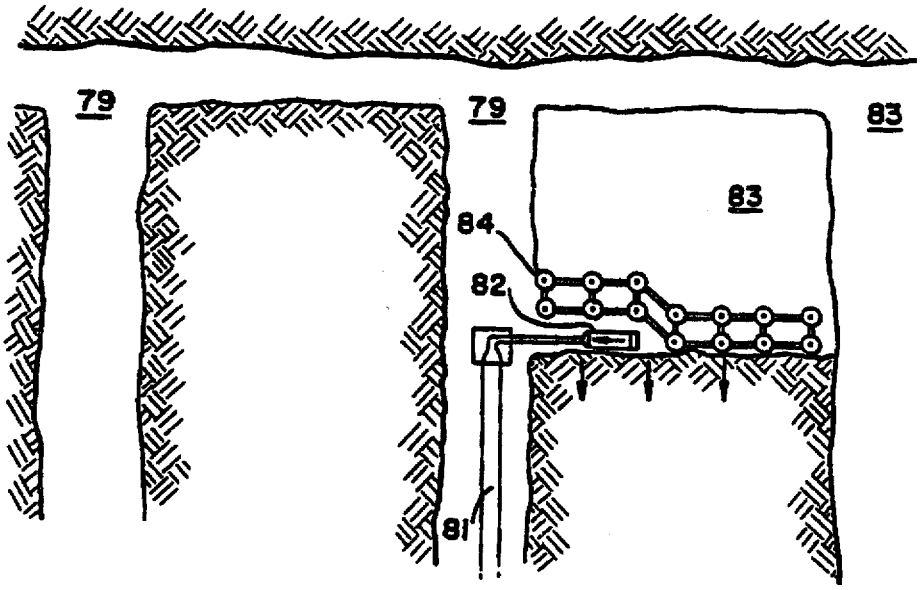
FIG. 15 is a plan layout showing multiple panel development and production in a mine opening constructed in accordance with the present invention.

With regard to FIGS. 12–15, the present invention may also be used to achieve uniform total extraction in retreat, with far less mechanical roof support and far greater safety than similar, conventional long wall mining methods. A mine shaft 76 is constructed in a generally vertical orientation to gain access to seams 77 of ore or coal. At the depth of each seam, primary development entries 78 are cut into the seam, radiating from the mine shaft 76. A plurality of secondary development entries are then cut from the primary entries into the seam. As shown in FIG. 13, these entries may define a rectilinear array, although the actual mineral formation and other geological features may determine that an irregular or non-rectilinear pattern may be required. It should be noted that the stress control method of the present invention may be used to form these primary and secondary development entries.

Total extraction of the seam may then begin at the distal end of the secondary entry which is spaced farthest from the shaft 76. With regard to FIG. 14, a belt conveyor 81 or the like is constructed in an entry 78, and a shear cutter or similar continuous mining machine is set up to begin cutting an opening 83 as described previously. As the opening 83 is established, a super-lifting array 84 is installed to support the roof load adjacent to the advancing face of the opening. The ore and rock removed from the room is transported through the secondary and primary development entries to the mine shaft, and thence to the surface. The wide openings formed by the present invention are optimal in removing the maximum amount of ore using the minimum amount of mining equipment and workers.

With regard to FIG. 13 once more, it may be appreciated that the openings 83 are advanced from the periphery of the mine toward the mine shaft. Furthermore, the panel developments of the openings 83 are extended from adjacent secondary entries 79, so that the openings 83 are joined, as in FIGS. 13 and 15, to form an enlarging singular excavation in which total extraction of ore is virtually complete. The excavation activity is carried out progressively toward the primary entries 78, and the openings are allowed to fail as the mining activity proceeds toward the primary entries and toward the mine shaft. It should be noted that the super-lifting arrays of the invention protect the miners and equipment during excavation, and that virtually no equipment or mechanical supports are sacrificed in this process. The total extraction process is excluded from the mine shaft pillar area 86, so that sufficient earth remains to support the mine shaft securely.

Figure 16:
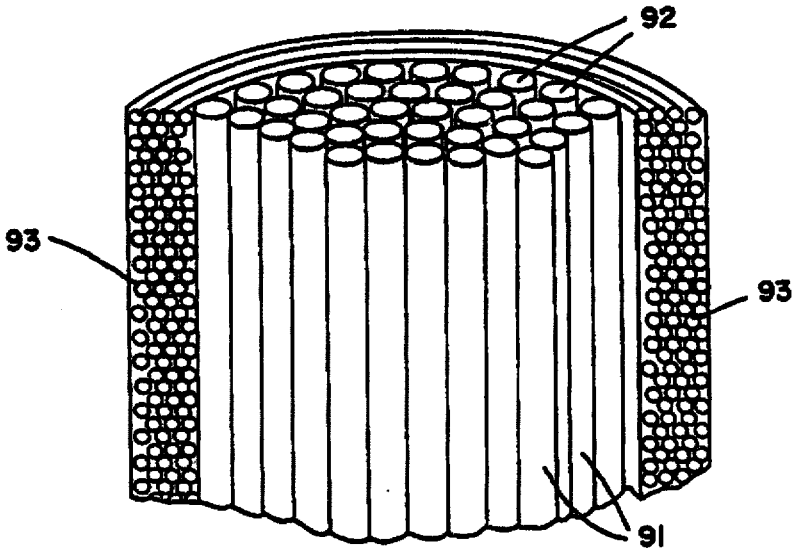
FIG. 16 is a fragmentary cross-sectional elevation of the construction of the super-lifting columns of the stress control machine of the present invention.

A significant contribution of the present invention is the design of the support assemblies 41 to exert the enormous foprces required to support the roof adjacent to the excavating face. With regard to FIG. 16 and 17, each support assembly 41 includes a column assembly 87 resting on a pedestal assembly 88. The upper end of the column is provided with an anvil plate 89 which is hardened to withstand impinging on the roof media with a force of 5,000–10,000 tons. A plurality of extension mimbers 94 are also provided, comprising essentially disk-like spacers which may be assembled to the column in various combinations to vary the nominal height thereof in accordance with the floor to roof spacing of the mine opening. The column 87 itself is comprised of a large plurality of hollow tubular members 91 which are tightly packed in a vertical orientation. The tubes 91 are formed of a light weight, high strength alloy tubing, and are filled with a light plastic material 92 which is generally incompressible. The bundle of tubes 91 is joined tightly together by a multi-laminar jacket of high strength fibers wound concentrically about the bundle. The high strength fiber material may comprise polyaramid fibers or the equivalent.

The super-lifting force is generated by a unique lifting jack disposed within the pedestal 88. As shown in FIGS. 18–23, the jack consists of a plurality of tubular members 101 connected to a header 102, which in turn is connected through a hydraulic line 109 to the high pressure supply of the hydraulic pump 44. Each of the tubular members 101 is formed of multiple concentric layers of woven filaments 103, the filaments extending generally longitudinally at oblique angles to the axis of the tubular member. The filaments 103 are preferably formed of polyaramid polymer or the equivalent, such material having a tensile strength several times the strength of steel wire. The tubular layers define a central chamber 104 which is lined with a yieldable plastic membrane to contain liquid, and the tubular braided layers provide reinforcement so that the chamber is capable of containing hydraulic fluid at extremely high pressure. Indeed, the system is designed to operate at 10,000 psi, and devices using the assembly 101 have been tested at 30,000 psi.

The tubular layers of braided filaments are gathered at one end of the assembly 101 and passed through a containment ring 106, from which the braided layers extend at 107 to a high pressure coupling with the header 102. At the other end, the tubular layers are also gathered through a ring and joined to a plug to seal the chamber 104. It may be appreciated that the assembly 101, which is normally flat when uninflated as in FIGS. 19 and 22, may become a rigid cylindrical tube when inflated with liquid at 10,000 psi, as in FIGS. 18, 20 and 21. The tube wall pushes outwardly with a pressure equal to the inflating pressure, and at 10,000 psi the force exerted by the tube is on the order of 700 tons per square foot. This amount of force per area is more than sufficient to support the roof load adjacent to a mine excavation face.

As shown in FIGS. 18,22 and 23, a plurality of tubular members 101 are oriented in parallel, abutting fashion, and disposed to be coupled in supporting fashion to the column assembly 87. The tubular members 101 are then inflated with increasing hydraulic pressure, the loaded, inflated tubes assuming the flattened disposition of FIG. 23. The distance through which the tubular members inflate comprise the maximum lifting distance of the assembly 41, and this distance is only a few inches. However, it should be noted that it is not necessary to displace the roof in order to support it and prevent roof failure, it is only necessary to exert sufficient pressure to counteract the roof burden. Additional jack travel may be achieved by utilizing several layers of tubular members 101 in vertically stacked arrangement, the tubes in each layer extending transversely to tubes in adjacent layers. The number of layers may be chosen to provide sufficient jack travel to accommodate all expected changes in the roof height.

Figure 17:
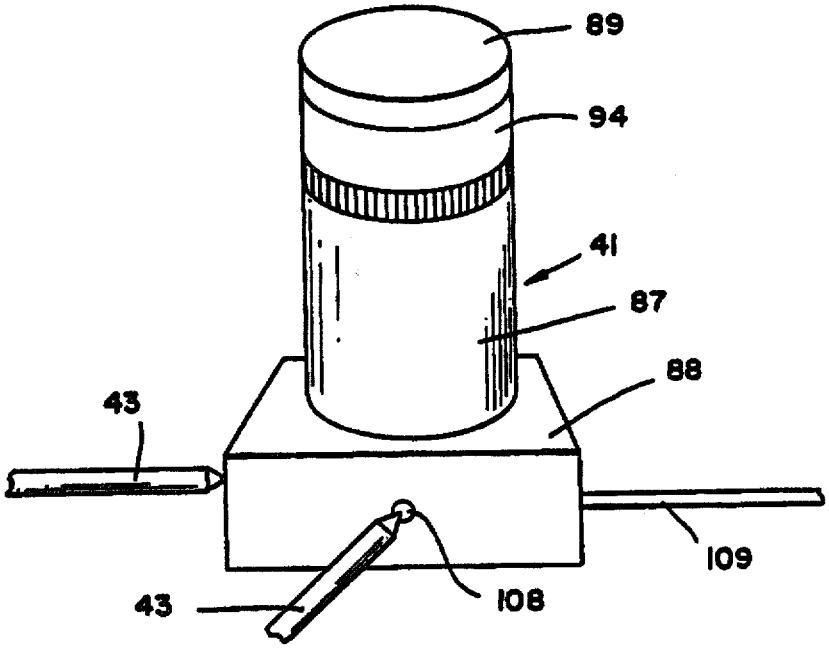
FIG. 17 is a perspective view of the super-lifting column assembly of the present invention.

The hydraulic arms 43 which translate each of the assemblies 41 with respect to the other assemblies 41 are connected through pivoting joints 108 to the pedestal base of each assembly 41, as shown in FIG. 17. It may be appreciated that any of the assemblies 41, when operating, is anchored by thousands of tons of force, and is a solid base from which any of the hydraulic arms may extend to translate any of the other assemblies 41 that are unloaded. Additional spacing disks 94 may be provided to adjust the column height so that the maximum excursion of the tubular members 101 is sufficient to impinge the anvil 89 upon the roof with full pressure. Thus unexpected changes in the geological formation that require changing the height of the roof can be accommodated. Although the assemblies 41 are capable of lifting several thousand tons, the total weight of a column having a typical 3.6 ft diameter is sufficiently small to permit handling by one person.

The method and apparatus of the present invention provide a revolutionary approach to mining, with benefits far greater than traditional mining methods. These benefits are summarized as follows: 1. Elimination of roof bolting, cribbing, arching, and roof maintenance.

2. Improvement in production by enlarging the room width from the conventional 20 feet width (in the case of coal mining) to 100 feet or greater, depending on the site specific conditions of the overburden.

3. Production efficiency is increased due to the elimination of cutting small rooms and yield pillars with the strict rule of the prior art Stress Control Method.

4. Streamlining the operation using the super-lifting stress control machine for both entry development entry and production panel mining.

5. The invention enables production in the manner similar to long wall mining, overcoming common problems encountered by the convention long wall method. Mobility of the new mining method and super-lifting machine provides flexibility in choosing cutting sequences to meet unpredictable changes in the ground geology, in which the conventional long wall mining method suffers serious difficulties.

6. The invention not only provides greater production efficiency and safety, it also provides automation of the production by enabling robotization of mine face advancement.

I claim:

1. A machanized, stress control mining method, comprising the steps of continuously excavating through an underground formation and advancing a mine face to form a mine opening having a low height/width ratio to enable the formation of an ambient stress envelope about the opening in the underground formation and to protect the medial portions of the roof and floor of the opening from failure, providing a stress control machine directly adjacent to the mine face to exert superlifting force in the range of 5,000–10,000 tons upon the mine roof to support the roof adjacent to the mine face and to displace the ambient stress envelope away from the roof and floor of the opening, and self-locomoting the stress control machine to move with the mine face as it is advanced.

2. A stress control machine for underground mines having a roof and a floor, comprising a plurality of superlifting column assemblies, each adapted to extend from the floor to the roof of the mine opening, telescoping means extending between adjacent superlifting column assemblies, means for selectively expanding each of said column assemblies to apply high pressure loads between the roof and floor, and control means both for selectively extending or retracting said telescoping means to translate any of said column assemblies with respect to the remainder of the column assemblies, and for selectively expanding each of said column assemblies to apply high pressure loads between the roof and floor in a predetermined loading pattern.

3. The stress control machine for underground mines of claim 2, wherein each of said superlifting column assemblies includes a plurality of upwardly extending, hollow tubular members, a generally incompressible filler material disposed in and completely filling said hollow tubular members, and means for joining said tubular members in a densely packed, parallel array.

4. The stress control machine for underground mines of claim 3, wherein said means for joining said tubular members includes an outer sleeve secured tightly about said densely packed, parallel array, said sleeve formed of high strength fiber wrapped about said array in multilayer, high tension fashion.

5. The stress control machine for underground mines of claim 2, wherein said means for selectively expanding each of said column assemblies includes a plurality of lifting assemblies, each of said lifting assemblies including a tubular, inflatable, high pressure hydraulic jack, and means for coupling said lifting assemblies to said column assembly to drive said column assembly upwardly by inflation of said tubular jacks.

6. The stress control machine for underground mines of claim 5, wherein each of said lifting assemblies comprises an expandable tubular member having a central chamber therein, a membrane impervious to hydraulic fluid lining said chamber, a plurality of superstrength filaments secured about said membrane and disposed in braided layers thereabout, and means for coupling said central chamber to a source of high pressure hydraulic fluid to inflate said tubular member.

7. The stress control machine for underground mines of claim 6 wherein a plurality of said tubular members are disposed in parallel, abutting relationship in a layer to form a column jack.

8. The stress control machine for underground mines of claim 7, further including a plurality of said layers of said tubular members disposed in vertically stacked relationship to increase the displacement of the column assembly.

9. The stress control machine for underground mines of claim 2, further including spider locomotion control means, comprising means for selectively expanding a first plurality of said column assemblies to engage the mine roof while deflating at least one of said column assemblies, actuating said telescoping means to translate said at least one column assembly to a new position, and then re-inflating said means for expanding said at least one column assembly to engage the roof in the new position.

10. The stress control machine for underground mines of claim 7, further including a pedestal base supporting each of said column assemblies, said column jack being disposed within said pedestal base.

11. The stress control machine for underground mines of claim 2, wherein said telescoping means comprises a plurality of telescoping arms, each extending between two adjacent column assemblies.

12. The stress control machine for underground mines of claim 11, further including pivoting joint means for connecting each said telescoping arms to one of said column assemblies.

13. The stress control machine for underground mines of claim 6, further including a ring member secured about said braided layers of filaments in constricting fashion to seal one end of said tubular member.

14. A stress control machine for underground mines having a roof and a floor, comprising a plurality of superlifting column assemblies, each adapted to extend from the floor to the roof of the mine opening, means for selectively expanding each of said column assemblies to apply high pressure loads on the order of 5000–10,000 tons directly between the roof and floor, a plurality of vehicles adapted for travel in an underground mine, said plurality of superlifting column assemblies secured to said vehicles for transport in said underground mine and for positioning at operational locations, and means for selectively expanding each of said column assemblies to apply high pressure loads between the roof and floor in a predetermined loading pattern.

15. The stress control machine of claim 14, wherein each of said vehicles include caterpillar track means for support and locomotion.

16. The stress control machine of claim 15, wherein each of said vehicles includes a front end and a bulldozer blade supported thereat.

17. The stress control machine of claim 15, wherein each of said vehicles includes a self-contained hydraulic system for operating said superlifting column assemblies supported on the respective vehicle.

18. The stress control machine of claim 15, further including a plurality of adjusting telescoping arms extending from said vehicles each arm secured to one of said superlifting column assemblies for transport thereof.

19. The stress control machine of claim 18, wherein each of said vehicles is joined to two pair of said superlifting column assemblies, each pair being disposed in longitudinally spaced relationship at opposed sides of said vehicle.

20. A mechanized, stress control mining method, comprising the steps of continuously excavating through an underground formation and advancing a mine face to form a mine opening having a low height/-width ratio to promote the formation of an ambient stress envelope spaced from the opening in the underground formation to protect the medial portions of the roof and floor of the opening from failure, providing a plurality of expandable column assemblies directly adjacent to the mine face to exert superlifting force directly between the mine roof and the mine floor to support the roof adjacent to the mine face, providing a plurality of vehicles to which said expandable column assemblies are secured for transport and positioning, expanding selected column assemblies of some of said plurality of vehicles to support the roof while advancing other of said plurality of vehicles of translate other retracted column assemblies connected thereto with the advancing mine face, thereby to advance said expandable column assemblies with said advancing mine face.

21. A mechanized, stress control mining method, comprising the steps of continuously excavating through an underground formation and advancing a mine face to form a mine opening having a low height-width ratio to promote the formation of an ambient stress envelope spaced about the opening in the underground formation and to protect the medial portions of the roof and floor of the opening from failure, excavating said mine face in the form of a pair of mine face walls disposed in oblique fashion to converge at a medial portion of the mine face and define a central support pillar in a Y configuration at said mine face, providing a plurality of expandable column assemblies directly adjacent to the mine face to exert superlifting force upon the mine roof and promote the formation of a protective stress envelope between said superlifting column assemblies and said central support pillar to support the roof adjacent to the mine face, and advancing said expandable support columns incrementally with the advance of said mine face walls.

22. The mechanized, stress control mining method of claim 21, wherein said mine face walls are formed to intersect and define a tapered central support pillar at the mine face and an open medial area throughout said mine opening.

23. The mechanized, stress control mining method of claim 21, wherein said mine face walls are formed to converge generally asymptotically and define a remaining curtain wall extending in the medial area throughout said mine opening.

24. The mechanized, stress control mining method of claim 23, wherein said curtain wall extends generally outwardly from said mine face to define a pair of adjacent corridors in said mine opening, one of said corridors comprising a fresh air path to said mine face and the other of said corridors comprising an exhaust air path from said mine face.

25. The mechanized, stress control mining method of claim 24, further including the step of forming a plurality of openings in said curtain wall at spaced intervals therealong to permit controlled air flow between said corridors.

26. The mechanized, stress control mining method of claim 23, further including installation of an ore conveying system extending from said mine face along one of said corridors adjacent to said curtain wall.

27. The mechanized, stress control mining method of claim 26, including the formation of a plurality of successive openings in said curtain wall, each adjacent to the advancing central support pillar to allow extension of the intake end of said ore conveying system from the corridor in which it extends to the mine face wall in the other of said corridors.

28. The mechanized, stress control mining method of claim 23, further including installation of a pair of ore conveying systems extending adjacent to said curtain wall from each of said mine face walls along respective corridors.

29. A stress control machine for underground mines having a roof and a floor, comprising a plurality of superlifting column assemblies, each adapted to extend from the floor to the roof of the mine opening, each of said superlifting column assemblies including a generally rigid column member and means for rendering said rigid column member incompressible along the longitudinal direction thereof, and a plurality of hydraulically inflatable, bladder-like jacks secured to said column member and disposed to exert superlifting force along said longitudinal direction when inflated.

30. The stress control machine of claim 29, wherein said column member includes a plurality of upwardly extending, hollow tubular members, and a generally incompressible filler material disposed in and completely filling said hollow tubular members.

31. The stress control machine of claim 30, further including means for joining said plurality of tubular members in a densely packed, parallel array.

32. The stress control machine of claim 29, wherein each of said plurality of hydraulically inflatable, bladder-like jacks includes an expandable tubular member having a central chamber therein, a membrane impervious to hydraulic fluid lining said chamber, a plurality of superstrength filaments secured about said membrane and disposed in conjoint layers thereabout, and means for coupling said central chamber to a source of high pressure hydraulic fluid to inflate said tubular member.

* * * * *